US005937913A

United States Patent [19]

Christe

[11] Patent Number: 5,937,913

[45] Date of Patent: Aug. 17, 1999

[54] WEFT THREAD DISTRIBUTOR APPARATUS OF A SERIES SHED WEAVING MACHINE

[75] Inventor: Marcel Christe, Rüti, Switzerland

[73] Assignee: Sulzer Rueti AG, Rueti, Sweden

[21] Appl. No.: 08/973,183

[22] PCT Filed: Apr. 26, 1996

[86] PCT No.: PCT/CH96/00156

§ 371 Date: Dec. 2, 1997

§ 102(e) Date: Dec. 2, 1997

[87] PCT Pub. No.: WO96/38612

PCT Pub. Date: Dec. 5, 1996

[30] Foreign Application Priority Data

Jun. 2, 1995 [CH] Switzerland ..... 1634/95

[51] Int. Cl.[6] ..... D03D 47/00

[52] U.S. Cl. ..... 139/28; 139/435.1; 139/450

[58] Field of Search ..... 139/28, 435.1, 139/450

[56] References Cited

U.S. PATENT DOCUMENTS

| | | | |
|---|---|---|---|
| 4,592,393 | 6/1986 | Steiner | 139/11 |
| 5,146,955 | 9/1992 | Steiner et al. | 139/450 |
| 5,406,985 | 4/1995 | Christe | 139/11 |
| 5,437,313 | 8/1995 | Christe | 139/28 |
| 5,439,037 | 8/1995 | Christe | 139/28 |

FOREIGN PATENT DOCUMENTS

| | | |
|---|---|---|
| 0 143 119 A1 | 6/1985 | European Pat. Off. . |
| 0 143 860 A1 | 6/1985 | European Pat. Off. . |
| 0 433 216 A1 | 6/1991 | European Pat. Off. . |

*Primary Examiner*—Andy Falik

*Attorney, Agent, or Firm*—Townsend and Townsend and Crew LLP

[57] ABSTRACT

Weft thread distributor apparatus for a series shed weaving machine in which a weft thread is fed into a connection channel via a supply nozzle and is distributed within the connection channel to shoot-in tubes. In order to achieve a trouble-free cutting off of the inserted weft and rerouting of the new weft thread tip a cutting device is placed spatially between the shoot-in tube and the clamping device in order that a retraction force and a loop standing under said retraction force are already formed due to of the supply nozzle and the injector nozzle prior to the stopping of the weft thread in the clamping device. During the stopping in the clamping device the thread is pre-tensioned in the cutting device and can be cut without difficulty. The loop unwraps itself and a new weft thread tip is inserted into the shoot-in tube.

6 Claims, 4 Drawing Sheets

WEFT THREAD DISTRIBUTOR APPARATUS OF A SERIES SHED WEAVING MACHINE

BACKGROUND OF THE INVENTION

1. Field of the Invention

The invention relates to a method for the operation of a weft thread distributor apparatus of a series shed weaving machine comprising a supply nozzle and an injector nozzle which blow a weft thread contrary to the direction of rotation of the weaving rotor into a connection channel between a spatially fixed ring part and a weaving rotor, with the weft thread being deflected out of the connection channel into a shoot-in tube and, after its insertion in the direction of insertion, being clamped and cut off behind the shoot-in tube when viewed in the direction of insertion in order to suck back a new weft thread tip which has arisen in this way and to blow it contrary to the direction of rotation of the weaving rotor into a further shoot-in tube.

2. Description of the Prior Art

An apparatus of this kind is described in EP-A-0 433 216.

A further similar apparatus is described in EP-B-0 143 860. This is, in particular, the part of the apparatus which is described on page 3, from lines 7 to 19.

Experiments with such weft thread distributor apparatuses have shown that it is not at all simple to hold a weft thread inserted into the weaving rotor in such a manner that it is uninfluenced by the cutting process and, on the other hand, to perform the cutting procedure for each new weft thread tip with a high accuracy of repetition.

SUMMARY OF THE INVENTION

The object of the present invention is thus to show a reliable method for an exact cutting to length of the new weft thread tip and for a trouble-free rerouting of this weft thread tip. This object is satisfied in that, when viewed in the direction of insertion, first a cutting device and then a clamping device is spatially arranged at the shoot-in tube; and in that, when considered temporally, a retracting force is already generated in the connection channel prior to the clamping of the weft thread which assists the braking in the clamping device and prevents the formation of a loop between the shoot-in tube and the clamping device during the cutting.

This sequence has the advantage that the weft thread is pre-braked and tensioned towards the end of its entry into the shed and does not continue moving toward the clamping device after its mechanical clamping in the clamping device. The actual stop-stroke is produced and taken up by the clamping device, whereas the retraction force is so great that it prevents the continued motion of the low thread mass between the connection channel and the clamping device in order to enable a cutting of the weft thread in the tensioned state.

The transition of the weft thread tip from the connection channel into the shoot-in tube through an inclined stripper shoulder which forms an obtuse angle with a partition plane to the spatially fixed ring part proceeds without difficulty. Thus, in the development of the connection channel there exists only a small partition gap to the spatially fixed ring part in the region of the stripper shoulder, whereas along the remaining periphery there is a cut-out groove on the rotor side which is cut out to a depth such that a minimum flow can be established contrary to the direction of rotation in the region of influence of the supply nozzle and the injector nozzle. On rerouting the new weft thread tip, it can be advantageous if additional nozzles are built into the spatially fixed ring outside of a pocket of the connection channel contrary to the direction of rotation which blow into the cut-out groove contrary to the direction of rotation at a desired point in time.

The precision of the cutting to length also depends on the repetition accuracy on actuating the injector nozzles and the possibly present additional nozzles. It is thus advantageous to produce the air pulses by an open control chain and kinematic correlation of the control valves with the rotational motion of the weaving rotor. Since several weft threads must be braked, cut under bias tension and rerouted one after the other, a rotary gate which distributes the air pulses one after the other to the nozzles responsible for the various weft threads is a particularly economical and accurate solution. The repetition accuracy is high due to the fact that an element with a low scatter in its opening and closing characteristics controls all injector nozzles or all additional nozzles. Furthermore, the pulse for all attached nozzles can be changed by adjusting this single element.

DESCRIPTION OF THE PREFERRED EXEMPLARY EMBODIMENTS

The figures deal with a weft thread distributor apparatus for a series shed weaving machine in which a weft thread is fed into a connection channel via a supply nozzle and distributed within the connection channel to shoot-in tubes. In order to achieve a trouble-free cutting off of the inserted weft thread and rerouting of the new weft thread tip, a cutting device is placed spatially between the shoot-in tube and the clamping device in order that a retraction force and a loop standing under this retraction force are already formed prior to the stopping of the weft thread by the clamping device. During the stopping in the clamping device the thread is pre-tensioned in the cutting device and can be cut off without difficulty. The loop unfolds itself and a new weft thread tip is inserted into the next shoot-in tube.

Figure 6:
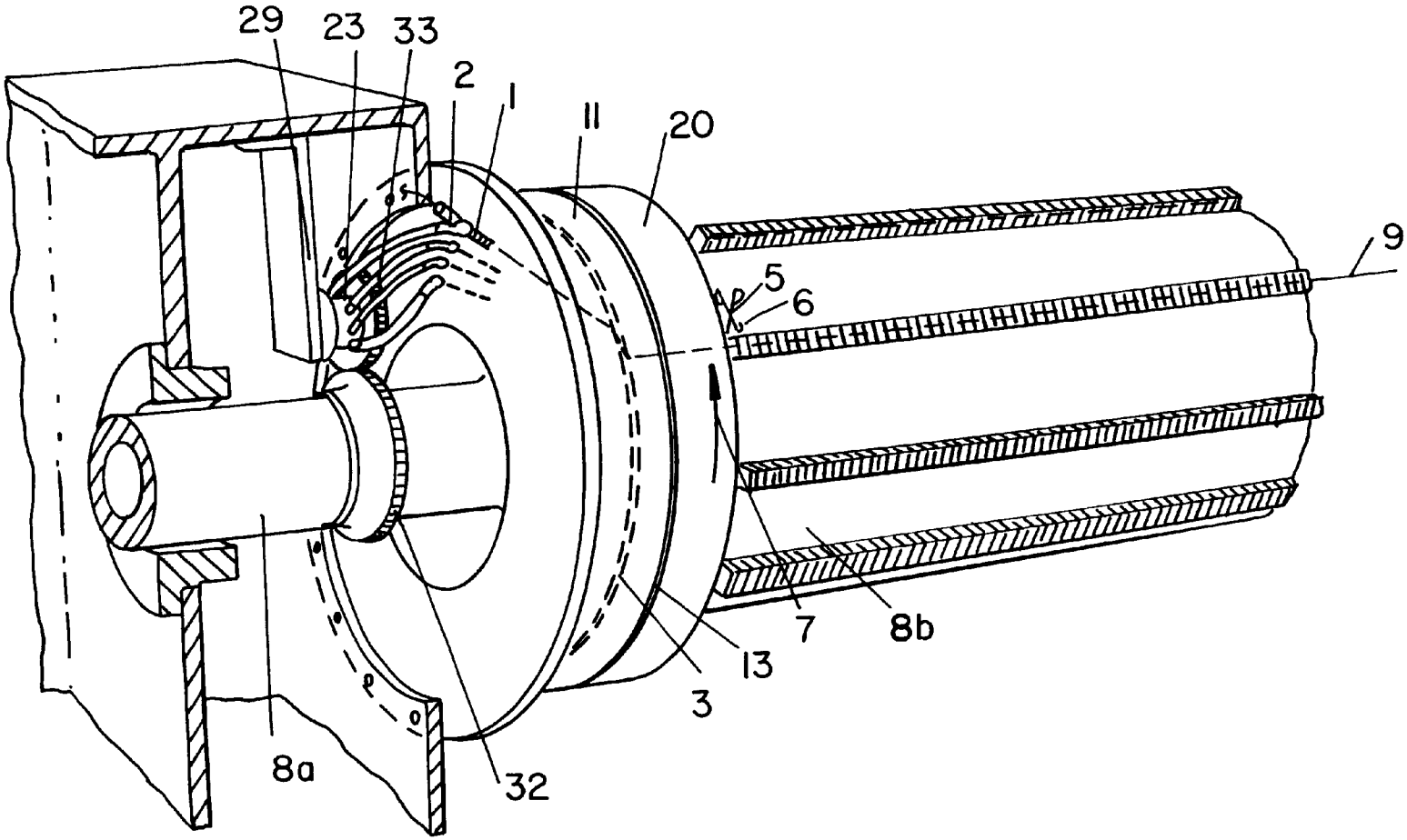
FIG. 6 is a partial perspective view of a weft thread distributor for a series shed weaving machine.

FIG. 6 shows a partial view of a weft thread distributor for a series shed weaving machine. A rotor 8 with a drum 8*b* and with a shaft 8*a* is supported at both ends by bearings of a machine housing. A ring part 11 of equal diameter as a take over ring 20 of the rotor 8 is supported by the machine housing. Several supply nozzles 1 feed weft threads 9 into individual rows of reeds, which are situated on the rotor 8. The transfer of the weft thread 9 from the stationary ring part 11 to the take over ring 20 takes place in a partition plane 13. Each of the nozzles 1 feeds into a different connection channel 3 of the partition plane 13. After the weft thread has been cut in a cutting device 5, the new tip is sucked back and directed against a direction of rotation 7 to a new shoot-in tube. Ejector nozzles 2, which also feed into the connection channels 3, support the formation of the new tip. A rotary gate 29, which is fixed to a housing wall 29 has a drive gear 32 engaged with a gear of the rotor shaft 8*a*. The rotary gate is connected by tubes to each of the ejector nozzles 2.

A take-over ring 20 connected to the weaving rotor 8 rotates in the direction of rotation 7 and rotates in a partition plane 13 with little clearance relative to a spatially fixed ring part 11. The connection channel 3 placed at a given radius is formed by a pocket 21 in the spatially fixed ring part 11 and by a cut-out groove 14 in the take-over part 20. The groove 14 is interrupted only in the region of the stripper shoulders 10. A weft thread 9 is delivered with constant velocity via a supply nozzle 1 and is blown into the connection channel 3 at an acute angle contrary to the direction of rotation 7 of the take-over ring 20. An injector nozzle 2 coaxial to the supply nozzle 1 is provided to augment the blowing effect. An additional nozzle 16 is placed in the spatially fixed ring part 11 after the pocket 21 contrary to the direction of rotation 7 and can blow contrary to the direction of rotation into the groove 14 which is rotating past in order to assist the transport of the weft thread during rerouting. Stripper shoulders 10 at the take-over ring 20 each deflect the air flow and the weft threads 9 into the shoot-in tubes 4, by means of which the weft thread is transported past a clamping device 6, 6' into a series shed of the weaving rotor. Ahead of the stripper shoulder 10 the groove 14 is made deeper and provided with relief openings 18 at its base in order to facilitate the deflection of the air flow and the weft thread into the shoot-in tube 4'. The suction effect of the additional nozzle 16 becomes really effective only when the deeper part of the groove 14 moves into the region of the pocket 21 and a consistently larger cross-section arises in the connection channel 3 (FIG. 3).

Figure 1:
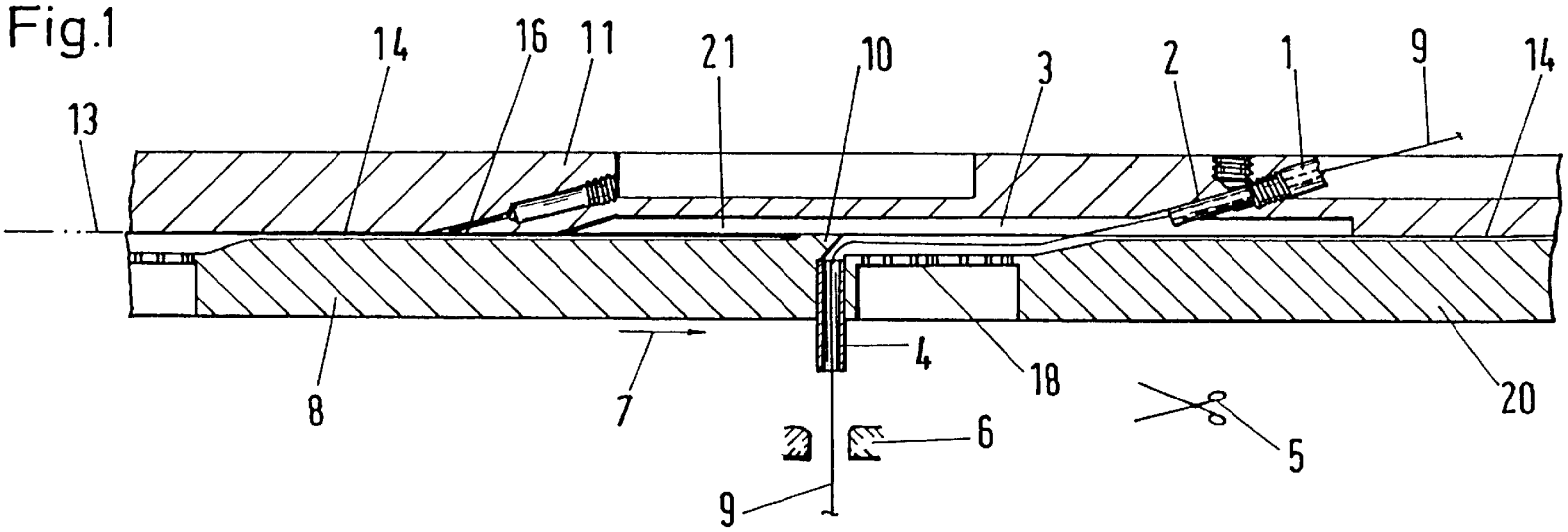
FIGS. 1 to 4 each schematically show an unwound section in a view in the direction of the partition plane between the weaving rotor and the spatially fixed ring part, and in each case along the connection channel for a weft thread, with the procedure for the rerouting of a weft thread being schematically illustrated.

In FIG. 1 the weft thread 9 proceeds without hindrance from the supply nozzle 1 contrary to the direction of rotation 7 into the connection channel 3 and further into the shoot-in tube 4 and a non-illustrated series shed. The open clamping device 6 is shown as co-rotating, whereas the cutting device is shown to be spatially fixed. The deflection into the shoot-in tube proceeds along the stripper shoulder 10, which forms an obtuse angle 12 (FIG. 3) to the partition plane 13. The connection channel is closed off at the end of the pocket 21 with the exception of the slightly cut out part of the groove 14 so that the main air flow passes through the shoot-in tube 4.

Figure 2:
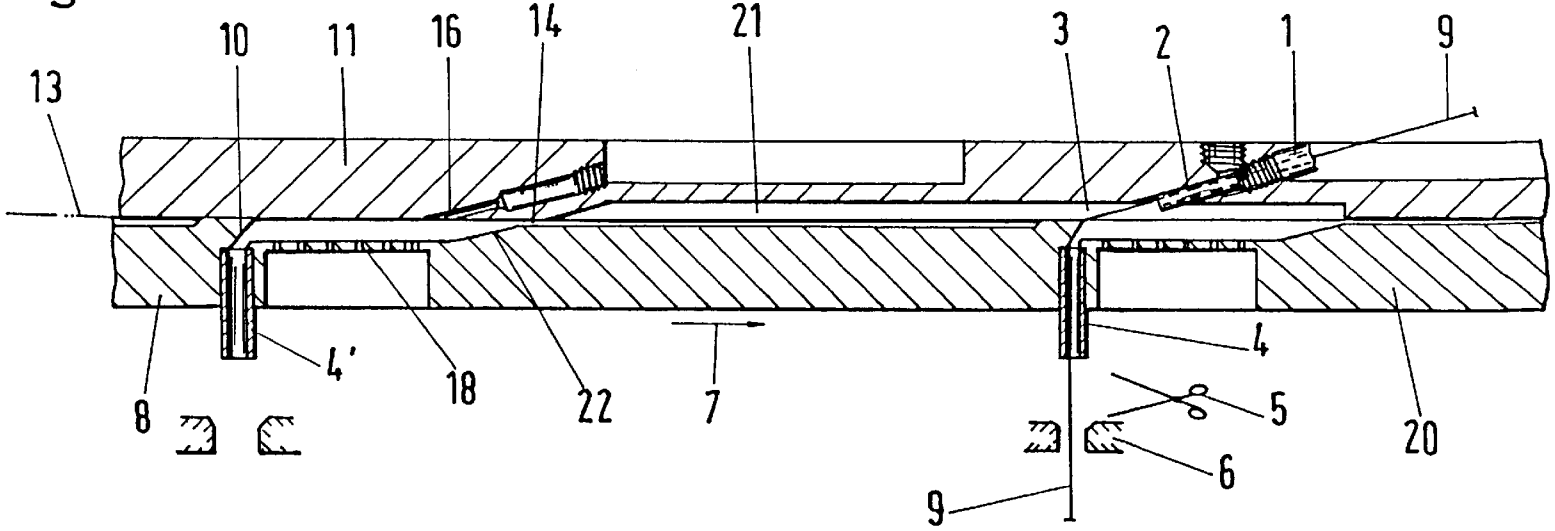

In FIG. 2 the weaving rotor 8 with the take-over ring 20 has already noticeably moved toward the open cutting device 5. The additional nozzle 16 can be actuated in order to produce a depression in the region of a slope 22 which assists the rerouting when the larger cross-section arises in the connection channel 3 (FIG. 3). Supply nozzle 1 and injector nozzle 2, if the latter has already been actuated, are still blowing against the slope of the obtuse angle 12 of the stripper shoulder.

Figure 3:
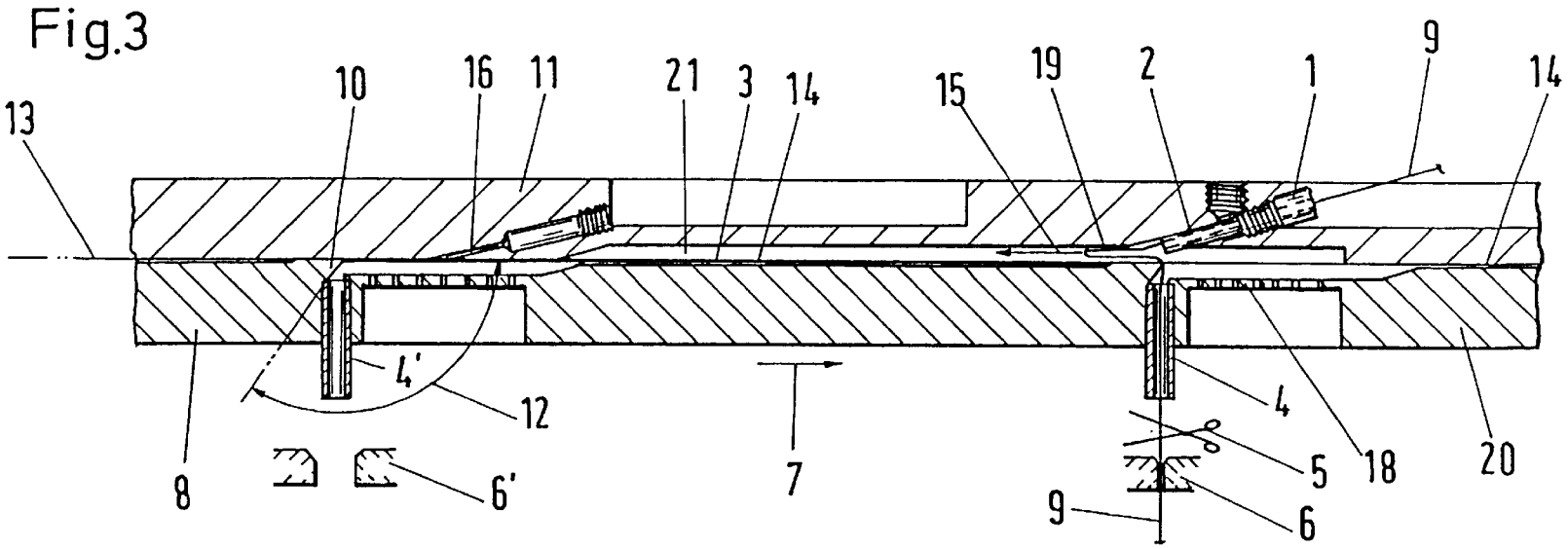

With the transition to FIG. 3 the edge of the stripper shoulder 10 has moved out of the air jet of the supply nozzle 1 and the injector nozzle 2. At the same time, the connection channel 3 has opened towards the additional nozzle 16 so that a continuous flow into the shoot-in tube 4' arises and a loop 19 is formed in the direction of this flow at which a retraction force 15 arises. This retraction force 15 acts in a braking manner on the weft thread 9 in the shoot-in tube 4. If the weft thread 9 is now arrested by the clamping device 6, the retraction force 15 is sufficient to hold the short thread portion up to the clamping device 6 under a bias tension and to prevent a thread loop in the region of the cutting device. Cutting is possible and the newly arising weft thread tip 17 is drawn back into the connection channel 3 until the loop is stretched out contrary to the direction of rotation 7 and the new weft thread is inserted into the shoot-in tube 4' and further into a new series shed, which is not shown here.

Figure 4:
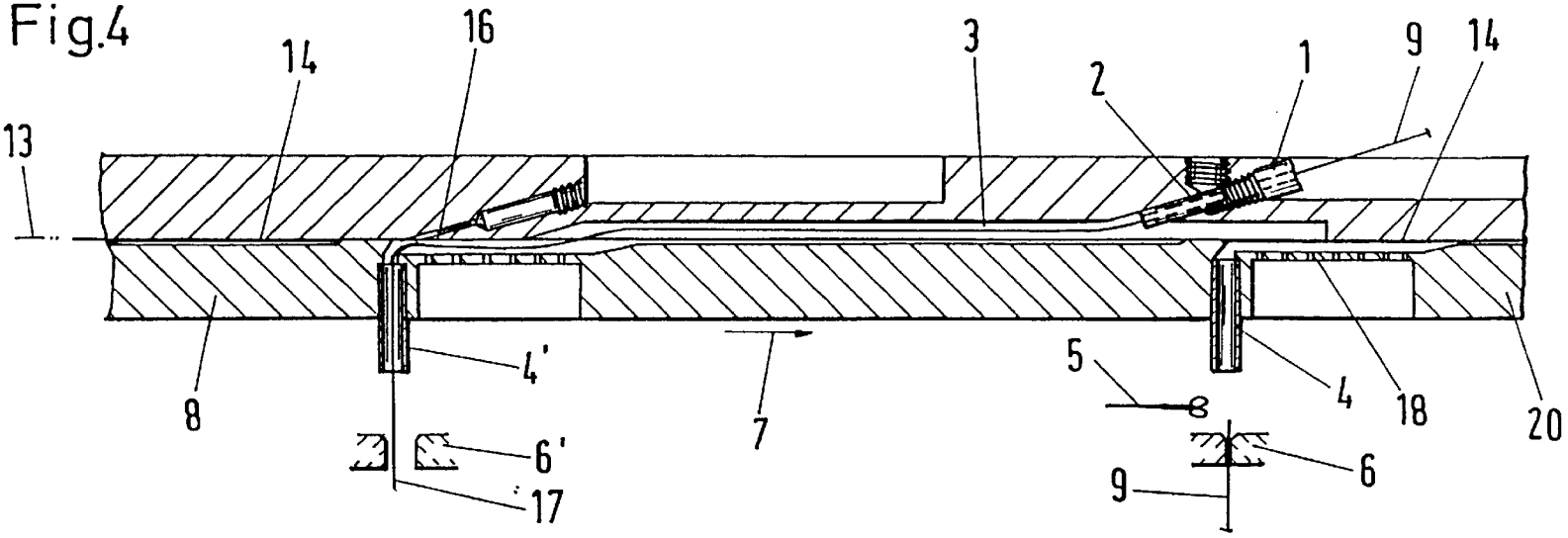

This new weft thread insertion is indicated in FIG. 4. In order to arrive at the state of FIG. 1 it is only necessary for the cutting device 5 to stand open, while the clamping device 6 can open in order to enable a beating up of the inserted weft thread.

Figure 5:
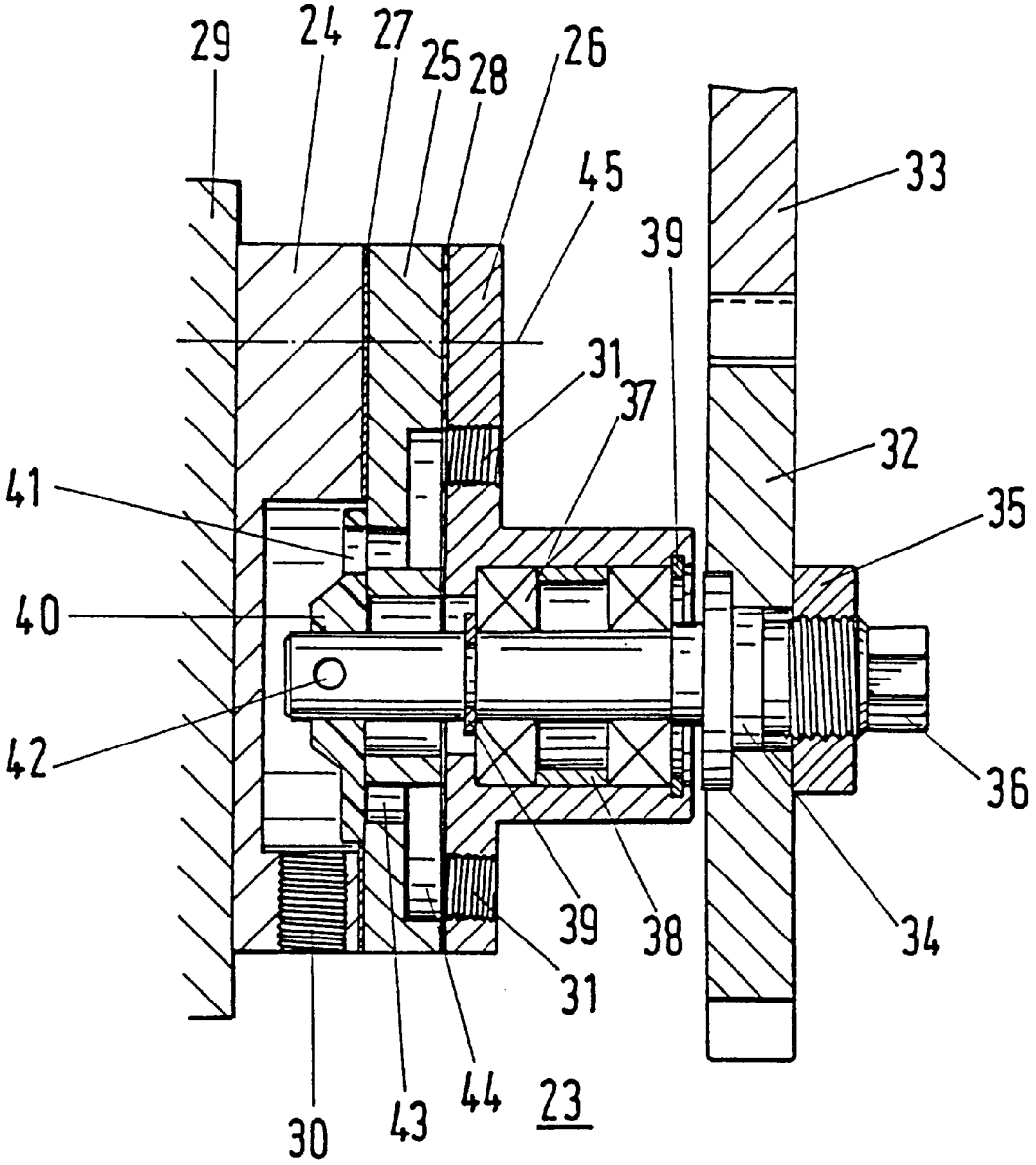
FIG. 5 shows a rotary gate kinematically connected via gears to a weaving rotor which can successively feed out to various injector nozzles one after the other in a cycle.

In order to produce a retraction force 15 with the aid of the injector nozzles 2 at the correct moment prior to cutting of the weft thread, each injector nozzle 2 must receive a precisely defined air pulse at a certain angular spacing to the edge of the stripper shoulders 10. A rotary gate 23 rotating in one direction, which directs pressure pulses from a compressed air line 30 in pulse feed lines 31 to the various injector nozzles and which is simultaneously connected kinematically, e.g. via gears, to the weaving rotor on which the stripper shoulders 10 are seated is shown in FIG. 5. The rotary gate 23 is secured by its housing base 24 to the side wall 29 of a series shed weaving machine in such a manner that its drive gear 32 is in engagement with a gear 33 of the weaving rotor. A middle part 25 and a cover 26 executed as a bearing carrier are connected to the housing base 24 via housing gaskets 27, 28 by means of screw connections 45. A shaft 34 is journalled in the cover 26 by means of bearings 37 and axially secured by means of a spacer sleeve 38 and securing members 39. The gear 32 is fastened to the drive side by means of a nut 35. Inside the housing 24, 25 a plastic disk 40 is fastened to the shaft 34 by means of a pin 42, with the disk 40 lying in sealing contact with the middle part 25. The disk has an aperture 41 which sweeps during the rotation over individual cut-outs 43 in the middle part 25 lying behind it at equal spacings on a circle and produces an air pulse during the time of each coincidence of the aperture 41 and a cut-out 43. The number of cut-outs 43 corresponds to the number of injector nozzles 2 in the spatially fixed ring part 11 (FIG. 3). The air pulse is conveyed via radial channels 44 in the middle part 35 to the individual pulse feed lines, for which only the connection bores 31 are shown here. If the pulse lines are also made to be of the same length, then the air pulses arrive at the expected time at the injector nozzles 2 in similar form and with high precision. The feed pulses are correctly synchronized even with changes of the speed of rotation and on start-up by virtue of the direct drive via the weaving rotor. Furthermore, the simple mechanism is distinguished by a high reliability of operation over long periods of time. An excessive demand on the parts subject to wear and an increase in the sealing gap between the disk 40 and the middle part 25 can be guarded against if the disk 40 is acted on by a metered axial force due, for example, to differing forces at the front side and at the rear friction side. To adjust the pulse start the nut 35 need only be loosened and the gear 32 rotated slightly with respect to the adjustment surfaces 36 at the shaft 34.

What is claimed is:

1. A method for the operation of a weft thread distributor apparatus of a series shed weaving machine, the machine comprising a supply nozzle, an injector nozzle, a weaving rotor, a connection channel, a shoot-in tube, a clamping device, and a spatially fixed ring part, the method comprising:

blowing a weft thread contrary to a direction of rotation of the weaving rotor into the connection channel between the spatially fixed ring part and the weaving rotor, the blowing being accomplished with the supply nozzle and the injector nozzle deflecting the weft thread out of the connection channel into the shoot-in tube;

clamping and cutting-off behind the shoot-in tube the weft thread when viewed in a direction of insertion;

sucking back a new weft thread tip that has arisen and blowing it contrary to the direction of rotation of the weaving rotor into a further shoot-in tube;

generating a retraction force, when viewed temporally, in the connection channel prior to the clamping of the weft thread which thereby assists in braking in the clamping device and thus preventing the formation of a loop between the shoot-in tube and the clamping device during the cutting;

wherein, when viewed in the direction of insertion, first the cutting device and then the clamping device is spatially arranged at the shoot-in tube.

2. A weft thread distributor apparatus of a series shed weaving machine, the apparatus comprising a supply nozzle, an injector nozzle, a weaving rotor, a connection channel, a spatially fixed ring part, a shoot-in tube, a second shoot-in tube, a cutting device, and a clamping device, wherein during operation of the apparatus, the supply nozzle and the injector nozzle blow a weft thread contrary to a direction of rotation of the weaving rotor into the connection channel between the spatially fixed ring part and the weaving rotor, with the weft thread being deflected out of the connection channel into the shoot-in tube and after the thread's insertion, the thread is clamped and cut off behind the shoot-in tube when viewed in a direction of insertion, thus sucking back a new weft thread tip that has arisen and blowing it contrary to the direction of rotation of the weaving rotor into the second shoot-in tube;

wherein when viewed in the direction of insertion, first the cutting device and then the clamping device is spatially arranged at the shoot-in tube;

wherein when viewed temporally, a retraction force is already generated in the connection channel prior to the clamping of the weft thread, which assists the braking in the clamping device and thus prevents the formation of a loop between the shoot-in tube and the clamping device during cutting; and wherein the transition from the connection channel into the shoot-in tube takes place by an inclined stripper shoulder that forms an obtuse angle with a partition plane between the spatially fixed ring and the weaving rotor.

3. An apparatus in accordance with claim 2 wherein the connection channel is cut out on both sides of the partition plane in the spatially fixed ring and in the weaving rotor, with a cut out groove being present in the weaving rotor over the entire periphery with the exception of the region of the stripper shoulders.

4. An apparatus in accordance with claim 2 wherein at least one further additional nozzle is arranged outside of a pocket of the connection channel in the spatially fixed ring contrary to the direction of rotation and furthermore blows, contrary to the direction of rotation, into the cut-out groove in order to assist the thread transport into the shoot-in tubes that are rotating past it.

5. An apparatus in accordance with claim 2 further comprising a rotary gate that has a fixed reduction ratio relative to the weaving rotor and that feeds compressed air for either the injector nozzles or additional nozzles from a compressed air supply line via a rotating aperture into pulse feed lines placed behind the aperture, with each of the pulse feed lines being led to one of the injector nozzles or additional nozzles placed at the spatially fixed ring part.

6. An apparatus in accordance with claim 5 wherein the pulse feed lines begin with cut-outs arranged uniformly about a circle after the rotating aperture in the direction of flow.

* * * * *